United States Patent [19]

Gabel et al.

[11] Patent Number: 4,779,558

[45] Date of Patent: Oct. 25, 1988

[54] IMAGE PERMANENCE DEVICE

[75] Inventors: Edward R. Gabel, Costa Mesa; Ronald R. Surya, El Toro; William J. Hanson; Mary B. Burke, both of San Diego, all of Calif.

[73] Assignee: Pierce Companies, Inc., Santa Ana, Calif.

[21] Appl. No.: 896,508

[22] Filed: Aug. 14, 1986

[51] Int. Cl.[4] ..... B05C 19/00; B05C 5/00; B05B 5/02; B05B 15/04

[52] U.S. Cl. ..... 118/46; 101/416 B; 118/301; 118/308; 118/656

[58] Field of Search ..... 118/656, 301, 308, 46; 101/416 B

[56] References Cited

U.S. PATENT DOCUMENTS

| | | | |
|---|---|---|---|
| 613,045 | 10/1898 | Pattberg | 101/416 B |
| 1,353,720 | 9/1920 | Carvalho | 427/7 |
| 1,445,273 | 2/1923 | Grammer | 101/422 |
| 1,470,344 | 10/1923 | Barber | 101/416 A |
| 1,638,574 | 9/1927 | Greenway | 118/200 |
| 2,252,204 | 8/1941 | Reilly | 427/211 |
| 2,681,637 | 6/1954 | Simpson | 118/308 |
| 3,125,465 | 3/1964 | Kuts | 118/244 |
| 3,613,636 | 10/1971 | Soures | 118/656 |
| 3,745,972 | 7/1973 | Thettu | 118/261 |
| 3,900,002 | 8/1975 | Stange | 118/656 |
| 3,911,160 | 10/1975 | Neuberg | 427/27 |
| 3,947,271 | 3/1976 | Munzel et al. | 430/122 |
| 3,989,569 | 11/1976 | Newman | 156/234 |
| 4,000,957 | 1/1977 | Ruhland | 219/216 |
| 4,075,362 | 2/1978 | Concannon | 430/99 |
| 4,458,625 | 7/1984 | Sakane et al. | 118/60 |
| 4,518,655 | 5/1985 | Henry et al. | 428/329 |
| 4,533,231 | 8/1985 | Shigenobu | 355/3 FU |
| 4,563,073 | 1/1986 | Reynolds | 355/3 FU |
| 4,622,914 | 11/1986 | Garris | 118/77 |

FOREIGN PATENT DOCUMENTS

| | | | |
|---|---|---|---|
| 704147 | 2/1965 | Canada . | |
| 40-13231 | 6/1965 | Japan | 118/656 |

*Primary Examiner*—Evan K. Lawrence

*Attorney, Agent, or Firm*—Knobbe, Martens, Olson & Bear

[57] ABSTRACT

A method and apparatus for preventing smudging of indicia printed on a surface by selective application of an amount of coating material to lubricate the contact with surfaces abrading the printed indicia or to provide physical separation from abrading surfaces, and thus prevent smearing. The coating material is preferably a "Teflon" micropowder that is applied by using impulse devices to dispense controlled amounts of the micropowder from a container, with the dispensed micropowder being transferred to, and passing through a plurality of apertures adjacent the surface of a piece of paper on which indicia has just been printed by a non-impact printer such as a laser printer.

17 Claims, 3 Drawing Sheets

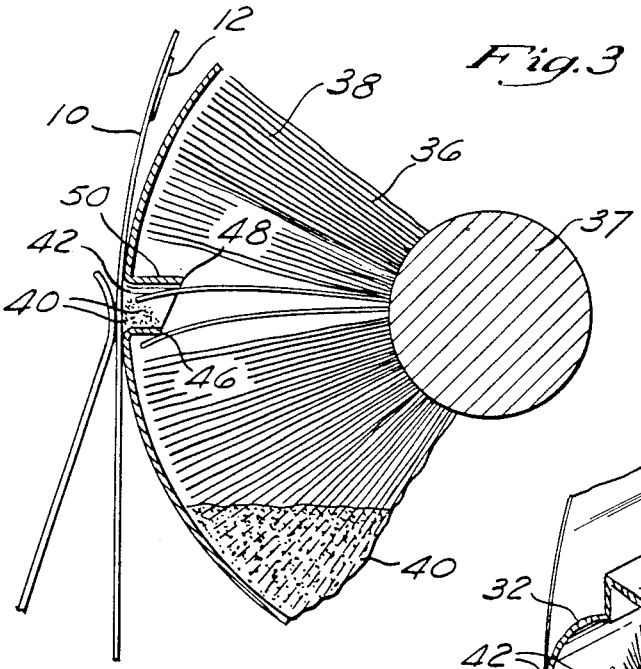
Fig. 3
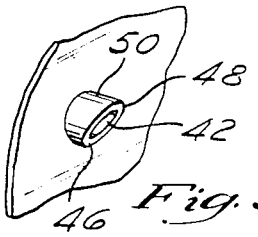
Fig. 3a
Fig. 4
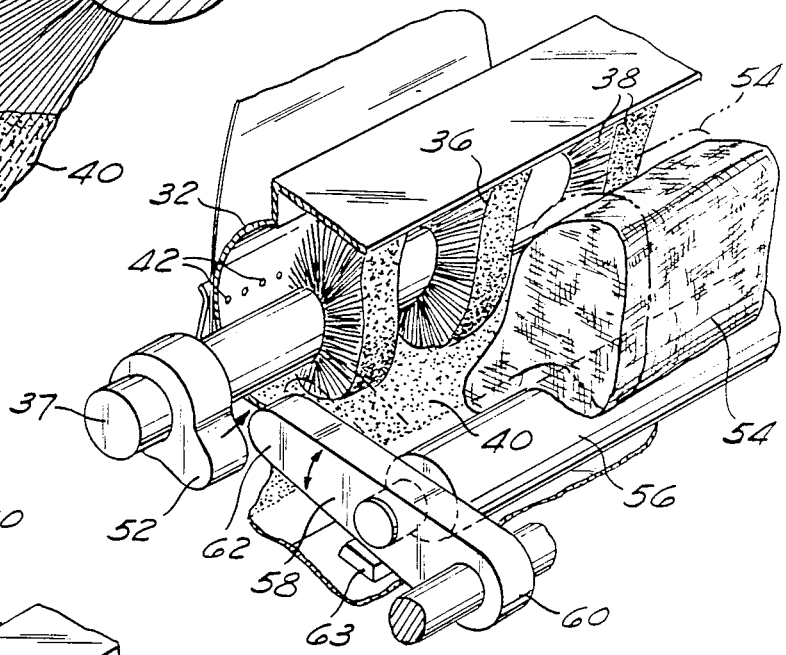
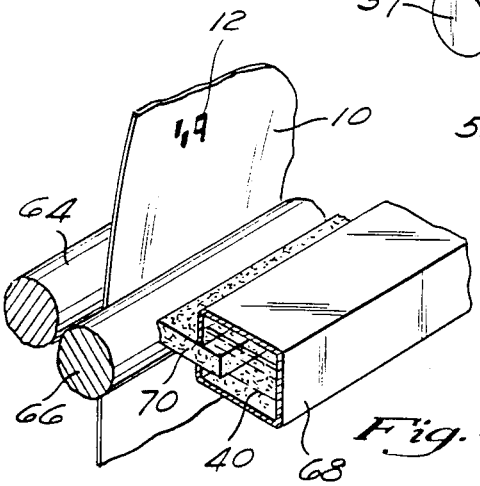
Fig. 5
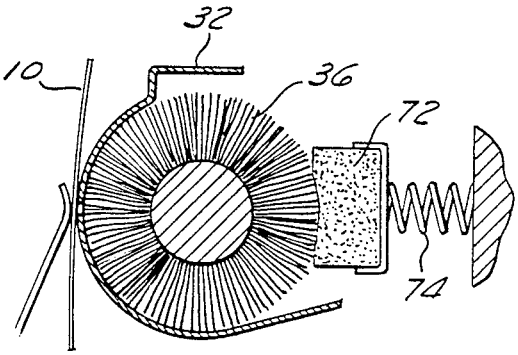
Fig. 6
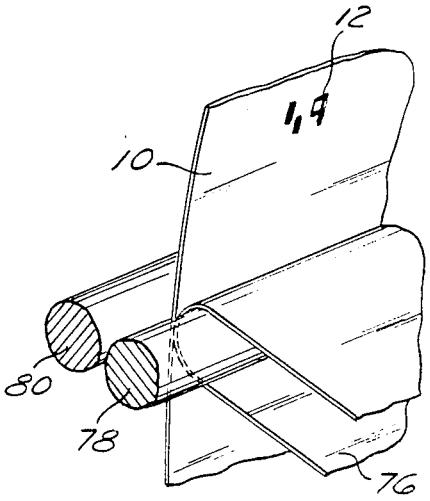
Fig. 7

Fig. 9
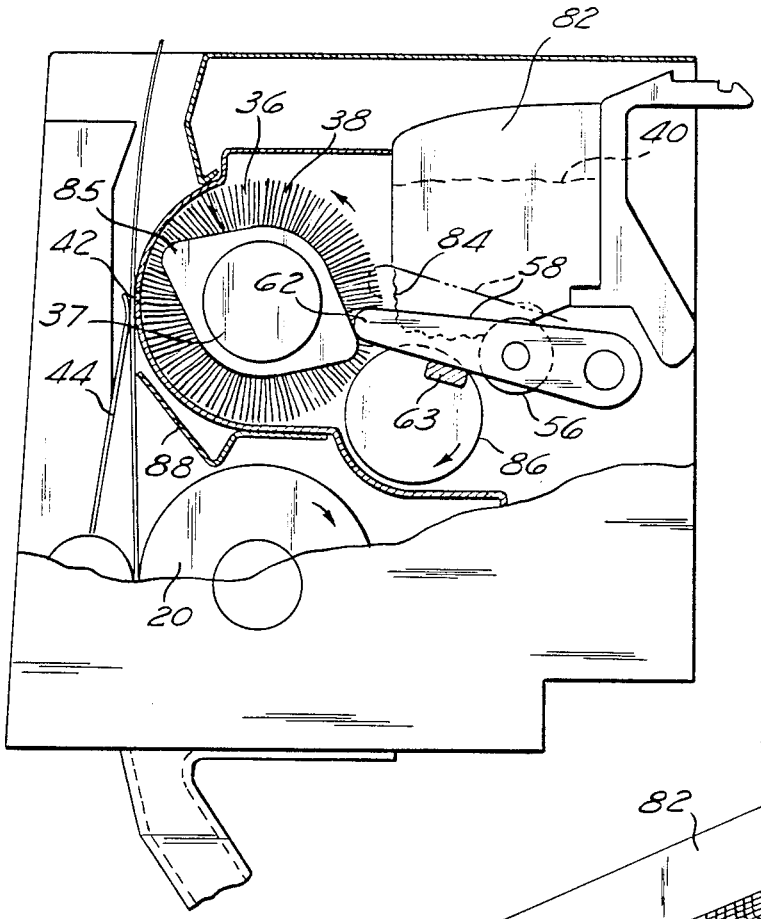
Fig. 10
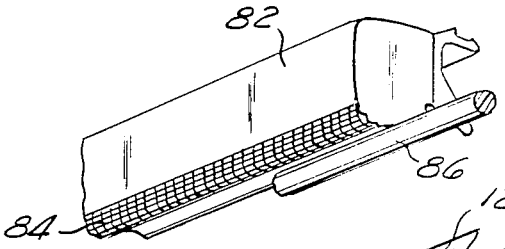
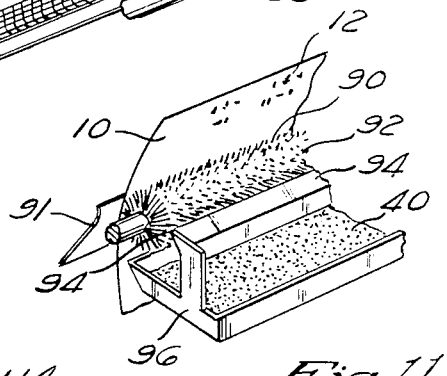
Fig. 11
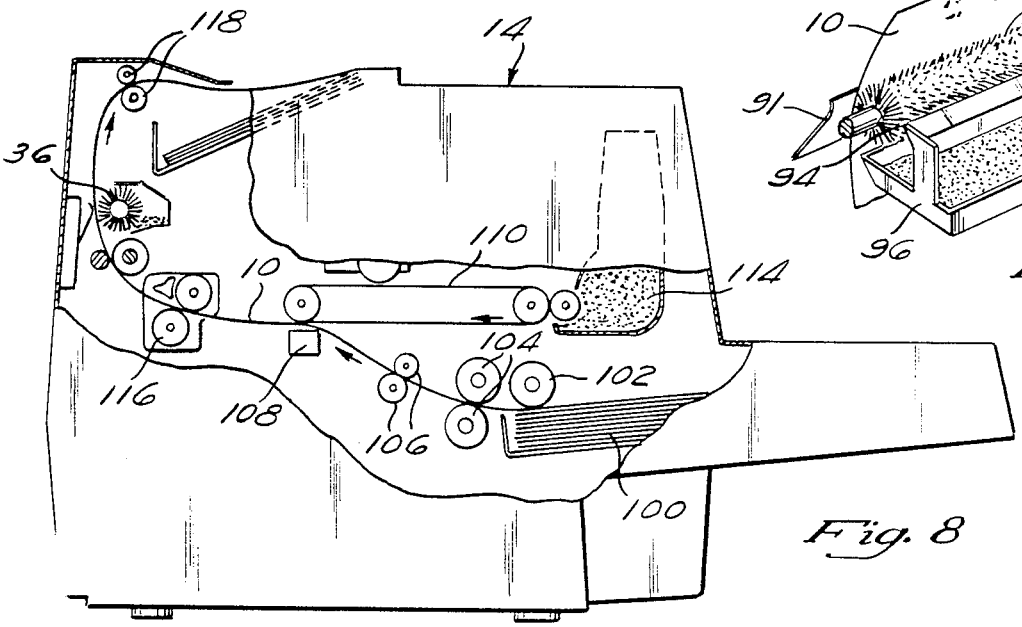
Fig. 8

IMAGE PERMANENCE DEVICE

BACKGROUND OF THE INVENTION

This invention relates to a method and apparatus for inhibiting smearing of printed data, and more specifically to inhibiting smearing of machine readable characters printed by a laser imaged electrophotographic printer on checks which will be passed through automatic reader/sorters to process the check.

Most people today have a personal checking account or a savings account through which they can write checks in order to transfer, or obtain money. In order to keep track of these checks, each check is typically coded with a machine readable number along the lower edge of the check. These checks are processed through reader/sorters, such as an IBM 3890, or a Burroughs 9190, in which the checks travel at speeds of about 300 inches per second. A single check may go through the reader/sorters several time during processing.

The check, and the printed account numbers, are passed by numerous drive rollers, belts and detection heads as they are processed. The contact with these various machine elements can cause physical damage to the checks, as well as smearing of the printed data on the checks. The machine readers which detect the account numbers printed on the checks are very sensitive so that even slight smears on the printed numbers can cause an inability to machine read the check. Because of the large number of checks processed, even a small percentage of unreadable checks can amount to significant numbers, and correspondingly significant delays and costs in processing of the checks.

The recent advent of laser printers has enabled banks to print check blanks while a customer is waiting. Thus, customers opening a new checking account can receive a supply of personalized checks for their new account, rather than the standard, nondescript checks which were previously issued until the more personalized checks could be obtained from the printer.

The data printed via non-impact printers which deposit the print on top of the paper, is more subject to smearing than checks printed by other processes. Such non-impact printers include laser electrophotograpahic printers, thermal transfer printers, ion deposition printers, ink jet printers, and magnetographic printers. Processing of checks printed by a non-impact printers thus leads to an unusually high percentage of checks which smear and thus cannot be adequately processed by conventional readers/sorters.

There is thus a need to reduce the smearing tendency of printed data printed by non-impact printers. This need is especially acute for data that must be machine readable, such as printed numbers on checks. The present invention selectively applies a minute amount of a selected protective coating to inhibit smearing of the printed data.

Processing paper through non-impact printers and copiers probably deposits negligible amounts of lubricant on the paper as from contact with rollers treated with silicone releasing agent to prevent sticking, as from contact with teflon impregnated transport rollers and guide rollers, as from contact with rollers which become coated with the fuser oil used in the printing process, and as from dripping oil and silicone lubricants. To the extent previous devices may have inadvertently and unintentionally placed a material or oil on the surfaces of paper during processing, that inadvertent coating is believed to be on the order of a few micrograms per print, which is not believed sufficient to act as a protective coating as described in this invention. In short, any inadvertent, residual coating placed on the paper or the printed data from the operating equipment, is not sufficient to prevent smearing of the printed data.

SUMMARY OF THE INVENTION

The present invention relates to a method and apparatus for preventing smearing of printed data, especiallly data printed by non-impact printers. For convenience, the present invention will be described primarily with reference to laser imaged electrophotographic printers. This smear inhibition is achieved by selective application of a protective coating material to the printed documents, after the documents have been printed.

The protective coating material is selected to be so as not to inhibit machine reading of the printed data. American National Standard Specification (ANSI) X3.2-1970(R1976) defines the requirements for machine readability of data which most manufacturers seek to satisfy, and those specifications are hereby incorporated by reference. Data may be machine readable yet still not satisfy the ANSI requirements. Further, several of the ANSI criteria are not readily determinable. However, a less exact, but practical test of what will satisfy the ANSI requirements and be machine readable is whether the data appears to be smeared when examined by the unaided eye.

For magnetic readability of data, there is a requirement is that there be no greater than a 0.001 inch spacing between the machine readable data and the machine head reading or detecting the data. Thus the amount of material applied must be minute so as not to apply too thick a layer. Thus preferably only a little of the material, a minute amount, need be applied in order to protect the data from unacceptable smearing.

Selecting a material that has a preferential attraction or adhesion to the printed data itself is also desirable. If possible, a material with a preferential bonding to the printed data is selected. This preferential attraction and bonding facilitates a selective application of the coating material to the printed data after it has been printed, and reduces the amount of material required. Only a little of the material, a minute amount, need be applied in order to protect the data from unacceptable smearing.

While the material is applied after printing of the data, it is selected to enable data to be written over the coating material. Thus the coating material protects what is already printed, but does not inhibit further recording of data over the coating material, as would occur by writing over the material with a ball point pen. The coating material also acts as a lubricant to prevent smearing of the printed data. Since it is typically difficult to write over a surface coated with a lubricant, the type of lubricant and the amount of lubricant used must be considered.

Several materials have been found suitable for this protective coating material. "Teflon" (trademark) fluorocarbon in a micropowder form, appears to work the best as it is so dispersed when applied in minute amounts that it does not impair the visual or machine readable aspects of data underneath the micropowder, it can be written over with a ball point pen after it is applied, appears to have a preferential attraction to data printed by a laser printer, and noticeably reduces smearing of the printed data. However, small amounts of wax, silicon oil, fuser oil, aqueous dispersions of "Teflon" fluorocarbon, and other lubricants are also believed to work to varying degrees if properly applied in the appropriate amounts.

Various ways of selectively applying the coating material are possible. Uniform application of the coating material to the documents on which the data has been printed is possible. Selective application of the coating material to the printed data itself minimizes the amount of coating material needed, and does not inhibit the ability to write on the document after coating.

In one such apparatus, a drive means such as a pair of rollers, engages a paper as it leaves a printer. The paper is fed into an applicator where a coating material is applied to the surface of the paper on which data is printed. The coating inhibits smearing of the data during subsequent handling of the paper.

A contact means, such as a spring, resiliently urges the paper against a container holding the coating material. A plurality of apertures in the housing, opposite the spring, control the rate at which the coating material is applied to the surface of the paper contacting the apertures. A rotating brush brings a continuous supply of coating material to the apertures, and can also be used to control the amount of coating material applied to the surface of the paper.

Thus, as the paper passes the apertures, a predetermined amount of the coating material is supplied to the surface of the paper. Preferably, the coating material is in a powdered form such that the bristles of the rotating brush pass through the powder and transfer a portion of the powder to the surface of the paper. Powdered teflon is such a preferred powder. Alternately, the brushes can engage a solid bar of the coating material so that the bristles of the brush abrade a controlled amount of material from the bar and transfer that material onto the paper. Wax, or a mixture of powdered teflon and wax are such a solid material.

In an alternate embodiment, the coating material is applied by passing the paper through a pair of rollers, with one of those rollers being in contact with a wick. The wick is in communication with a fluid dispersion of the coating material so that the wicking action of the wick controls the amount of coating material applied to the roller, and thus applied to the paper. A dispersion of powdered "Teflon" plus appropriate wetting agents in water, as produced by Dupont, is one such fluid dispersion.

In another embodiment, the coating material is dispensed from a container having one or more holes that are sized with respect to the particle size of the coating material to act as a sieve to distribute a controlled amount of coating material every time the container is mechanically agitated. A projection on the brush shaft acts as a cam to actuate a lever, which in turn raises and drops the container and thus dispenses the coating material from the container. A rotating shaft transfers the dispensed coating material to where it can be picked up by the bristles of a rotating cylindrical brush. The bristles of the brush then pick up the coating material shaken from the container and transfer that coating material to the surface of the paer. In a variation of this embodiment, the rotating shaft is omitted, with the bristles of the brush picking up the dispensed coating material without an intermediate transfer element such as the rotating shaft.

In yet another embodiment, the coating material comprises wax, and is contained on a strip of waxed paper. The waxed paper passes through a pair of rollers with the waxed surface in contact with the printed indicia on the paper. The rollers have an interference fit so the wax surface is pressed against the printed indicia. Interference fits of at least 0.010 inches are believed preferable. The waxed paper is moved at a different rate through the rollers than is the paper with the printed indicia so that wax is rubbed from the wax paper onto the printed indicia and onto the paper surface on which the printed indicia is printed. Moving the waxed paper 20 to 30 times slower than the paper having the printed indicia is believed preferable.

DESCRIPTION OF THE DRAWINGS

The above and other features and advantages of the invention will be more apparent from the following description of a particular, preferred embodiment of the invention, as illustrated in the accompanying drawings.

FIG. 3 is an alternate embodiment of this invention showing a flicker mechanism;

FIG. 3*a* is a perspective view of the truncated column 50 of FIG. 3;

FIG. 4 is an alternate embodiment of this invention showing a shaker;

FIG. 5 is an alternate embodiment of this invention showing a wick action;

FIG. 6 is an alternate embodiment of this invention using a solid bar of coating material;

FIG. 7 is an alternate embodiment of this invention using a pair of rollers to transfer wax from waxed paper onto the paper bearing the printed indicia;

FIG. 8 shows the paper path in a conventional device using a laser printer;

FIG. 9 shows an alternate embodiment of this invention using a shaker;

FIG. 10 shows a perspective view of a portion of FIG. 9; and

FIG. 11 shows a device to remove a portion of the coating material from a coated piece of paper.

DESCRIPTION OF THE PREFERRED EMBODIMENT

Figure 1:
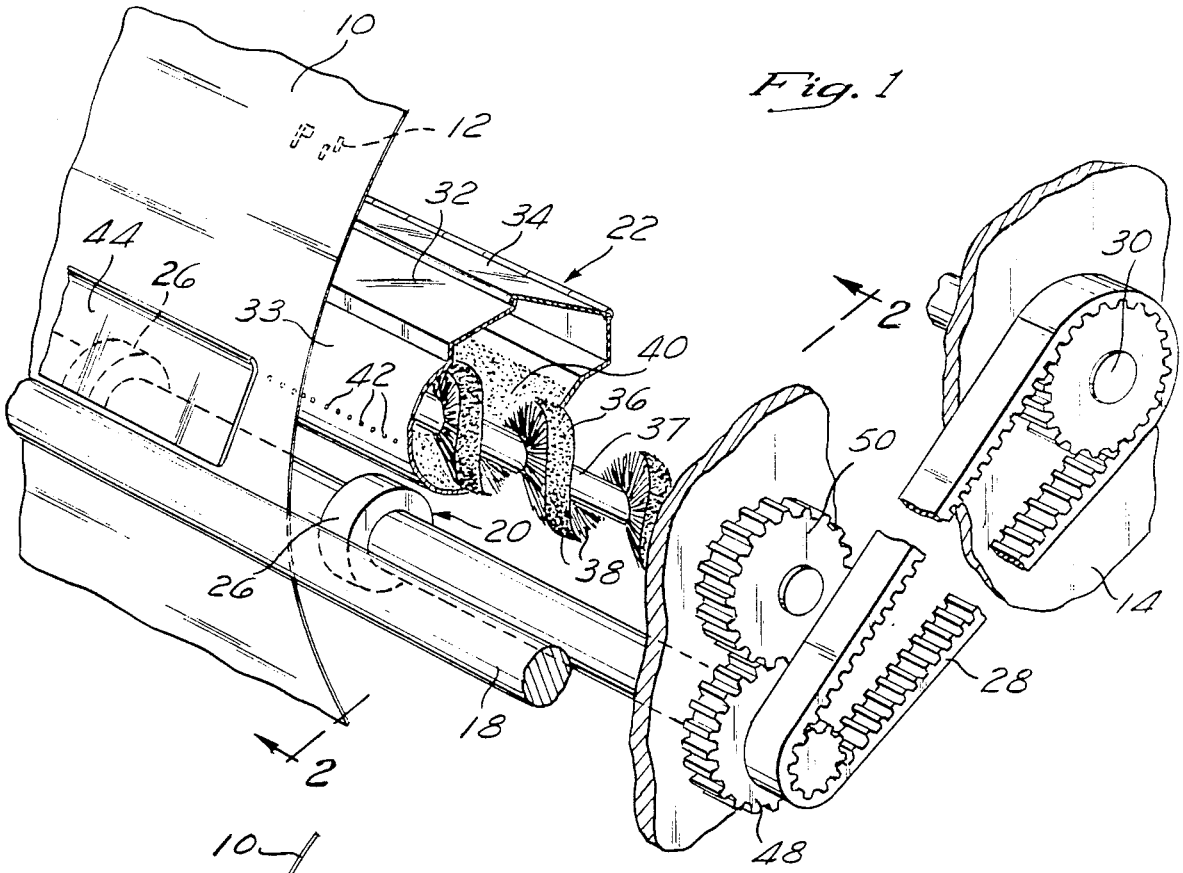
FIG. 1 is an exploded perspective view of this invention.

The preferred embodiment of this invention will be described as a way to prevent smearing of data printed by a laser printer. The particular embodiment described is intended to be added onto a conventional printer, and thus the particular apparatus described is designed to fit into an existing space along the path which the printed paper travels for handling by a conventional laser printer.

Referring to FIG. 8, the path of a piece of paper 10 travels during printing in a conventional laser printer 14 is illustrated. The paper 10 is withdrawn from a paper tray 100 by a prefeed roller 102. A pair of feed rollers 104 and transport rollers 106 move the paper 10 to a transfer corona unit 108 which transfers particles of toner from a photosensitive medium such as rotating belt 110.

A uniform electric charge is placed on a photoreceptor belt. An optical laser unit scans the photoreceptor belt and selectively discharges the photoreceptor producing an electrostatic latent image of the document being printed. The latent image is made visible by applying a toner to the belt 110 at the toner unit 114. The toner replicating the indicia is transferred to the paper 10 by the transfer corona unit 108.

A fusing unit 116 fuses or bonds the toner to the surface of the paper 10 to form the printed indicia 12 (not shown). The fusing unit 116 typically comprises a pair of rollers having an interference contact between the rollers, with one of the rollers being heated so as to apply heat and pressure to bond the toner to the paper 10. The paper 10 is then guided out through a pair of exit rollers 118. The image permanence device of this invention is preferably designed to fit within the housing of the laser printer 14, along the path the paper 10 normally travels in passing between the fusing unit 116, and the exit rollers 118, as indicated in FIG. 8 and as described hereinafter.

The operation of the image permanence device is briefly described with reference to FIGS. 1 and 2, which show a piece of paper 10 having indicia 12 thereon. The paper 10 exits from the fuser unit 116 (FIG. 8) in the laser printer 14. The paper 10 passes through paper guides 16 (FIG. 2), which guide the paper 10 so that it passes between idler roller 18 and drive roller 20. The rollers 18 and 20 drive the paper 10 through an applicator 22 where the printed indicia is coated with a material to prevent smearing. The coated paper 10 then continues on along the normal path it would have traveled in the laser printer 14.

In more detail, the printed indicia 12 is shown as a raised portion on the surface of the paper 10. Most photocopy processes, and laser printers, result in the printed indicia 12 having at least a portion of the printed indicia 12 extending above the surface of the paper 10. The amount by which the printed indicia 12 extends above the surface of the paper 10 varies depending upon the process used, and the type of materials used in printing.

For example, conventional laser printers use materials which are only slightly absorbed by the paper 10, with the result that the printed indicia 12 is predominantly above the surface of the paper 10. Conventional photocopy materials have printed indicia 12 which extends by varying amounts above the surface of the paper 10, depending upon the desired output optical density and process variables such as toner particle size and uniformity of the image process.

At the other extreme, impact printers or indentation printers form physical indentations into the surface of the paper 10 such that the printed indicia 12 lies predominantly at, or below, the surface of the paper 10. There is little problem with smearing of this type of printed indicia 12 using conventional reader/sorters, primarily, it is believed, because the printed indicia 12 is below the surface of the paper 10 and thus not readily subject to abrasion by contacting surfaces.

The paper guides 16 comprise sheets of material such as metal or plastic, but preferably metal. The paper guides 16 are configured to guide the paper along a predetermined path through the laser printer 14 and through the applicator 22. The paper guides 16 are supported by the housing of the laser printer 14, a portion of that housing being shown in FIG. 2 as housing 46.

The drive roller 20 is a cylindrical shaft, preferably made of aluminum. The drive roller 20 is located with its longitudinal axis parallel to the plane in which the paper 10 travels, and substantially perpendicular to the direction in which the paper 10 travels. The drive roller 20 is rotatably mounted to allow rotation about its longitudinal axis by means wellknown in the art and not described in detail herein.

The drive roller 20 has circumferential grooves 24 at four locations along its length. An O-ring 26, having a circular shape, and generally circular cross-sectional shape, is partially contained in the grooves 24. The O-ring 26 has an interior diameter sufficiently smaller than the diameter of the grooves 24 so that the O-rings 26 do not slip in the grooves 24.

The drive roller 20 is connected by drive means such as a chain belt or a rubber belt 28 to a paper drive roller 30 contained in the laser printer 14. Thus, the normal paper transportation system of the laser printer 14 drives the roller 20.

The idler roller 18 is a longitudinal cylinder, preferably made of steel with a silicone rubber coating to increase frictional contact with the paper 10. The longitudinal axis of roller 18 is substantially parallel to that of drive roller 20. The idler roller 18 is rotatably mounted to allow rotation about its longitudinal axis by means well known in the art and not described in detail herein.

The idler roller 18 is placed adjacent to the exterior surfaces of the O-ring 26, and sufficiently close to the O-ring 26 such that the O-ring 26 can frictionally engage and press the paper 10 against the roller 18 with sufficient force and frictional engagement to transport the paper 10. The rollers 18 and 20 provide an independent transport means for transporting the paper 10 through the applicator 22.

The applicator 22 comprises a container such as housing 32. The housing 32 runs substantially the width of the paper 10 along which printed indicia 12 is printed, although if only a portion of the printed indicia 12 is to be coated, the length of the housing 32 and other components could be adjusted accordingly. The housing 32 has a portion 33 with a generally cylindrical exterior and interior shape, immediately adjacent the printed indicia 12 on the paper 10. Opposite the cylindrical portion 33 is a hinged door 34 which can be opened to provide access to the interior of the housing 32.

Inside the housing 32 is a brush 36. The brush 36 is cylindrical in shape and has its longitudinal axis substantially parallel to the longitudinal axis of the drive roller 20. The brush 36 has bristles 38 connected to a central shaft 37 that runs along the longitudinal axis of the brush 36. The shaft 37 is rotatably mounted to rotate about its longitudinal axis by means well known in the art and not described in detail herein. The bristles 38 connect to the shaft 37 and extend generally radially outward. The bristles 38 can form a generally cylindrical surface with the bristles 38 uniformly distributed over that surface, but preferably the bristles 38 connect to the shaft 37 along a spiral path extending the length of the brush 36, as illustrated best in FIG. 1. The bristles 38 extend generally radially outward from the longitudinal axis of the brush 36.

Inside the housing 32, and in contact with the brush 36, is the coating material 40. Preferably, the coating material 40 comprises powdered "Teflon" fluorocarbon, as described later in more detail. The brush 36 is caused to rotate, pick up a minute amount of the coating material 40, and deposit the coating material 40 on the surface of the paper 10 containing the printed indicia 12.

The cylindrical portion 33 of the housing 32 abuts the surface of the paper 10 containing the indicia 12. That abutting portion of the cylindrical portion 33 contains an aperture which allows the coating material 40 to be transferred from the bristles 38 of the brush 36 onto the surface of the paper 10 and printed indicia 12. The aperture can comprises a longitudinal slot, but preferably takes the form of a plurality of apertures 42, which preferably comprise a line of circular holes. Holes having a diameter of about 0.050 to 0.060 inches, and spaced approximately 0.100 to 0.200 inches apart, have been found suitable for the preferred embodiment.

Figure 2:
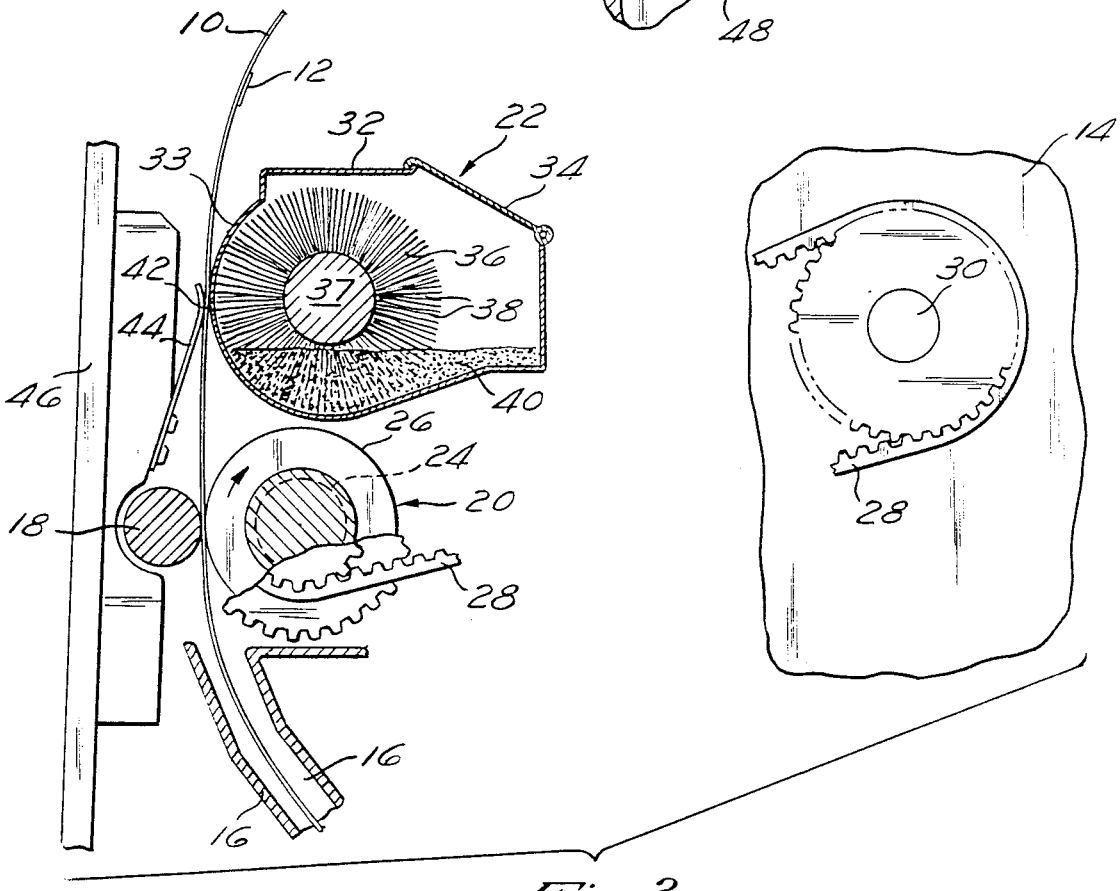
FIG. 2 is a cross-sectional view taken along lines 2—2 of FIG. 1.

In FIG. 2, the coating material 40 is shown located in the lower portion of the housing 32. When the supply of the coating material 40 becomes too low, additional material can be added through the door 34. The bristles 38 of the brush 36 pass through the coating material 40, and transfer a portion of that coating material 40 to the aperture 42. The size, shape, location and orientation of the aperture 42 can be used to control the amount of coating material 40 distributed to the surface of the paper 10. The rotational speed and design of brush 36 can also be varied to control the amount of coating material 40 distributed to the aperture 42, and thus to the paper 10.

Preferably the coating material 40 is uniformly applied to the surface of the paper 10. To the extent the physical spacing of the apertures 42 do not provide a continuous or constant coating of material 40, the physical handling of the paper 10 will cause the coating material 10 to spread slightly or migrate and provide a substantially continuous coating over the surface of the paper 10.

It is possible to apply the coating material 40 only over a portion of the paper 10, or only over a portion of the printed indicia 12. In such cases, there may be some slight migration or mobility of the coating material 40. Preferably the coating material 40 is not so mobile as to substantially reduce the inhibition on smearing of the printed indicia 12. The migration and spreading tendencies for all of the various coating materials 40 have not been determined for the various ratios of coated area to uncoated area and for the various means of causing the coating material 40 to migrate or be removed.

The paper 10 is urged against the cylindrical portion 33 and the apertures 42 by a spring 44. Where there is no paper 10 between the spring 44 and the paper 10, the spring 44 abuts the apertures 42 so as to prevent the coating material 40 from continuing to exit from the apertures 42. The spring 44 comprises a leaf spring which runs along the width of the paper 10, opposite the apertures 42. The spring 44 has one end grounded, or connected to a stable structure such as the housing 46 of the laser printer 14. The other end of the leaf spring 44 contacts the paper 10 opposite the apertures 42 so as to place the paper 10 immediately adjacent the apertures 42. A piece of mylar sheet having a thickness of 0.004 inches is believed to be suitable use as the spring 44.

Referring to FIG. 1, the brush 36 is rotated by gears 48 and 50, which are attached respectively to the ends of the drive roller 20 and the brush 36. Since the drive roller 20 is driven by roller 30 in the laser printer 14, the laser printer 14 essentially drives the brush 36.

The coating material 40 preferably comprises powdered "Teflon" fluorocarbon. The preferred powdered "Teflon" is a fluorocarbon micropowder, DLX 6000, produced by DuPont, and is advertised as an additive for plastics, rubbers, and greases.

The exact mechanism by which the coating material 40 prevents smearing of the printed indicia 12 is unknown. It is hypothesized that the coating material 40 provides a lubricating layer on the paper 10 and the printed indicia 12 to prevent abrasion and smearing of the printed indicia 12. The nature of laser printers and other non-impact printers is to leave a portion of the printed indicia 12 projecting above the surface of the paper 10, as previously described. It is believed that without the coating material 40, the printed indicia 12 frictionally abrades and smears. The abrasion is believed to be primarily caused by rubbing between the printed indicia 12 and the paper 10 or other surfaces in the processing machines.

The coating material 40 is believed to prevent this abrasion and smearing by providing a mobile material, or lubricant to facilitate slipping, rather than abrasion, and to the extent abrasion occurs, it is abrasion of the mobile coating material or lubricating coating material 40, rather than abrasion of the printed indicia 12. Under this hypothesis, the coating material 40 provides a mobile material that acts as a lubricating means to inhibit the printed indicia 12 from smearing.

It is also believed that the powdered "Teflon" is preferentially attached to the printed indicia 12 rather than being uniformly spread over the surface of the paper 10. This preferential attachment is believed due to the triboelectric, or static electric charge at or in either the printed indicia 12, or in the Teflon powder.

It is believed that "Teflon" fluorocarbon is readily charged and when so charged has a preferential attachment to the printed indicia 12. Alternately, the triboelectric charge can be in the printed indicia 12, with the "Teflon" fluorocarbon being attracted to the triboelectric charge in the printed indicia 12. Such a triboelectric attraction could result from contact between the printed indicia 12 and a roller in the printing machine that is of a dissimilar material, or coated with a material that induces a triboelectric charge.

Under this preferential attraction approach, there is provided a means for preferentially applying more of the lubricating coating material 40 to the printed indicia 12, as distinguished from the paper 10, in order to inhibit smearing of the printed indicia 12.

It is also hypothesized that a secondary mechanism inhibiting smudging and smearing of the printed indicia 12 results from the physical separation of the paper 10 from any abrading surface, with the physical spacing being caused by the insertion of a thin layer of the coating material 40. Under this hypothesis, the coating material 40 provides a means for providing a physical separation between a printed indicia 12 and the abrading surface so as to inhibit smearing. If the separating material is sufficiently immobile, then it can achieve the same results as the lubricant which was previously discussed.

It is not definitively known whether the mobile material, the lubrication, the physical spacing, some combination of the two aspects, or some other effect, causes the coating material 40 to reduce smudging of the printed indicia 12. It is known, however, that if a sufficient amount of the coating material 40 is placed on the surface of the paper 10, or on the printed indicia 12, that the smudging of the printed indicia 12 is greatly reduced, and is reduced such that the printed indicia 12 does not smudge during multiple passes through conventional readers/sorters.

The minimum amount of coating material 40 which must be placed on the paper 10 in order to prevent smudging of the indicia 12, is not precisely known. The coating material 40 must be sufficiently thick to prevent abrasion and smudging of the printed indicia 12. When the coating material 40 comprises Teflon fluorocarbon micropowder, one-half (½) to 5 milligrams of the coating material 40 is believed suitable for use to coat one entire surface of the paper 10 having printed indicia 12 covering about 5% of the area of the paper 10, with the paper 19 having a size of 8½ by 11 inches, and an area of 93.5 square inches, or about 603 square centimeters. Thus coverage density of about 0.8 micrograms per square centimeter, to about 17 micrograms per square centimeter of the coated area are believed to be preferable.

These 0.8 to 17 microgram amounts are minute. However, they are believed to be hundreds if not thousands of times larger than the insignificant amounts of materials inadvertently applied to the surface of papers by dirty rollers, leaking oil, and unintentionally transferred fuser oil.

While the minimum amount of the coating material 40 is presently believed to be on the order of milligrams per print, the maximum amount of the coating material 40 usable is presently unknown, but can be bounded in the extreme cases by the ability to write on the paper 10. A person must be able to write on the paper 10 coated with the coating material 40. Ball point pens, which are commonly used to sign checks or make post processing notations on the checks, do not write well on well lubricated surfaces. Attempts to write on lubricated surfaces with a ball point pen cause the pen to skip or write sporadically, and leaves ink with uneven density and line width if the pen writes at all. Further, the 0.001 inch spacing requirement between the machine reading heads and the printed indicia 12 places physical size limitations on the coating material 12 in many instances.

When using "Teflon" fluorocarbon micropowder as the coating material 40, the maximum preferred amount of about 17 micrograms per square centimeter of coated area is the amount at which the micropowder becomes messy to handle, the powder beings to become visible, it starts to fall off the paper 10, and because it does not remain on the paper 10, it becomes insufficient from both a cost and effectiveness viewpoint.

Further, the coating material 40 should be applied in sufficiently minute amounts so as not to impair the machine readability of the indicia 12, as specified by the ANSI specifications. Preferably the coating material 40 is applied in sufficiently small amounts so as to be transparent to the eye so as not to degrade the readability of the printed indicia 12. The preferred "Teflon" fluorocarbon micropowder is a white color, and is opaque if applied in sufficient quantities. When applied to the print 10 is the specified quantities, however, the "Teflon" is sufficiently dispersed so as to not be readily visible by the unaided eye, and does not impair the machine readability of the printed indicia 12.

Tests have been run in which conventional, uncoated checks containing printed data 12 were tested on a Southland Rub Tester, made by the James River Corporation, Kalamazoo Michigan. The Rub Tester bore U.S. Pat. No. 2,734,375. In this Rub Tester, two sheets of paper 10 having printed indicia 12, were placed so that the printed indicia were on abutting surfaces. One of the papers was stationary, while the other was fastened to a four pound weight which reciprocated at a predetermined rate in strokes of about two inches length.

Using the Southland Rub Tester, uncoated checks printed by a variety of non-impact techniques lasted from four (4) to sixteen (16) rubs using a four (4) pound weight, until smearing was perceptible by the unaided eye. These non-impact printing techniques included thermal printers, ion deposit printers, magnetic printers, and laser printers.

The roughness of the surface finish on the paper 10 affects the smear resistance of the printed indicia 12. In tests using 20 pound Simpson opaque bond paper, which had a surface roughness of about 80 to 150 Sheffield, tests on the Southerland Rub Tester produced visibly perceptible smears after 128 rubs with one (1) milligram of "Teflon" fluorocarbon, on up to about 200 rubs with ten (10) milligrams of "Teflon". The "Teflon" was applied to 8½ by 11 sheets of paper 10, with the printed indicia 12 covering about 5% of the surface of the paper 10. Thus a coating of about 0.8 micrograms per square centimeter laster about 128 rubs, while a coating of about 17 micrograms lasted about 200 rubs, before smearing was visually perceptible by the unaided eye.

Test data indicates that about 0.5 to 1 milligram of "Teflon" fluorocarbon micropowder, or about 0.4 micrograms per square centimeter will increase the smear resistance of the printed indicia 12 about four (4) times over the smear resistance of the uncoated indicia 12. Alternately phrased, a fourfold improvement is experienced for a coating of about 0.4 micrograms per square centimeter. A coating of about 0.8 to 17 micrograms per square centimeter will allow the printed indicia 12 to be rubbed about sixteen (16) times more than the uncoated indicia 12.

A preferred sheet of 8½ by 11 inch paper for use with this invention appears to have a basis weight of abut 24 pounds, a porosity of about 12 secs. min. (Gurley), a surface finish of about 80 to 150 Sheffield, a moisture content of 4.5–5.5%.

Referring to FIGS. 3 and 3*a*, there is shown an alternate embodiment for applying the coating material 40. In this embodiment, the edge of the aperture 42 has an upper or first projection 46, and a lower or second projection 48, which can be formed by opposing edges of truncated column 50. The bristles 38 of the brush 36 pick up the coating material 40. In FIGS. 3 and 3*a* the bristles are shown as rotating in a clockwise direction which is opposite to that of FIG. 2. The reversal in direction could be obtained by gear means well known in the art and is not described in detail herein.

The first projection 46 acts as a cocking mechanism to bend the bristles 38. When the bristle 38 passes over the projection 46, it acts like a bent spring that has been released and thus projects the coating material 40 through the aperture 42 and onto the paper 10. Alternately phrased, the projection 46 and bristles 38 use the spring action of the bristles 38 to flick the coating material 40 through the aperture 42. The second projection 48 projects more than does the first projection 46. The projection 48 further helps to dislodge the coating material 40 from the bristles 38 as the bristles 38 slap against the first projection 48 so as to cause more of the coating material 40 to dislodge and pass through the aperture 42. The projections 46 and 48 thus provide a flicking means to project the coating material 40 through the aperture 42.

FIG. 4 shows another alternate embodiment for distributing a controlled amount of the coating material 40 to the brush 36. The central axis of the brush 36 has affixed thereto, a projection 52, which acts a rotating cam. Adjacent the brush 36, but not in contact therewith, is located a container having at least one aperture, but preferably having plural apertures such as a sieve.

The apertures are sized with respect to the particle size of the coating material 40 to restrain the coating material 40 from freely flowing through the aperture, but allowing the material 40 to pass through the aperture under a slight impulse force. Still more preferably, the container takes the form of a bag 54 containing the coating material 40. The coarseness of the material of the bag 54 serving to control the amount of coating material 40 dispensed for a predetermined impulse or shake of the bag 54.

The bag 54 is supported by a rod 56, the longitudinal axis of which is substantially parallel with the longitudinal axis of the brush 36. The ends of the rod 56 are in turn connected to, and supported by, a lever 58. A first end 60 of the lever 58 is mounted so that it can pivot. The opposing, or second end 62 of lever 58 is located so as to contact the projection 52. As the projection 52 rotates with the brush 36, the projection 52 acts as a cam to raise the end 62 of the lever 58. As the projection 52 rotates past the end 62, the lever 58 slides off of the projection 52. The lever 58, rod 56 and bag 54 will then be dropped. The bag 54 will come to a sudden halt against stop means such as stop 63.

The sudden stop will impart a sudden impact, impulse, or shake to the bag 54. The coating material 40 will thus be shaken or jiggled out of the bag 54. The brush 36 then picks up the coating material 40 shaken out of the bag 54 and transfers it to the paper 10 as previously described. The projection 52 and lever 58 thus provide a means to mechanically agitate, or mechanically impart an impulse to the bag 54.

The porosity of the material used to form the bag 54, and the amount of impulse transmitted by the cam action of the projection 52 and the end 62, can be used to determine the amount of coating material 40 metered onto the brush 36. There is thus provided an alternate means for providing coating material 40 to the paper 10.

Referring to FIG. 5, there is shown an alternate embodiment for applying the coating material 40 to the paper 10. In this alternate embodiment, the paper 10 passes through two idler rollers 64 and 66. The rollers 64 and 66 comprise longitudinal cylinders, with their longitudinal axis substantially parallel to the axis of the drive roller 20. The rollers 64 and 66 are both rotatably mounted, and spaced sufficiently apart so as to allow the paper 10 to pass between them, yet still contact the surfaces of the paper 10. A container 68 holds a fluid dispersion of the coating material 40. An aqueous dispersion of water and powdered "Teflon" has been found suitable for this use.

A wick 70 communicates the aqueous dispersion of the coating material 40 between the container 68 and the roller 66. The surface tension, or wicking action of the fluid dispersion containing the coating material 40 can be used to regulate the amount of coating material 40 distributed to the roller 66 and thus placed on the paper 10. The amount of coating material 40 in the fluid dispersion can also be used to regulate the amount of coating material applied to the paper 10. In tests, an aqueous dispersion of fluorinated ethylene propylene copolymer, sold as Teflon Fluorocarbon dispersion FEP 120, TE 9503, by Dupont in Wilmington, Del., has been found usable.

FIG. 6 shows an alternate embodiment for applying the coating material 40 to the paper 10. In that embodiment, the coating material 40 is placed in a solid form such as bar 72. A spring 74 urges the bar 72 into contact with the brush 36 so as to ensure a continued supply of the coating material 40 (bar 72) to the brush 36, and hence to the paper 10. The bar 72 could be made out of wax, or a mixture of wax and "Teflon". The preferential application of more coating material 40 to the printed indicia 12 than to the surface of the paper 10 is also believed to be possible using the embodiment of FIG. 6.

FIG. 7 shows yet another embodiment for applying the coating material 40 to the paper 10. In this embodiment, the coating material 40 comprises wax, and is applied from wax paper 76. The paper 10 passes between rollers 78 and 80, which rollers have their longitudinal axis substantially parallel to the longitudinal axis if drive roller 20. The rollers 76 and 78 are placed so that the surfaces of the rollers are normally in contact if there is nothing between the rollers.

The wax paper 76 passes around roller 78 so that the wax paper 76 and the paper 10 both pass between the rollers 78 and 80. The waxed surface of the wax paper 76 is in contact with the surface of the paper 10 on which the printed indicia 12 is printed.

Drive means known in the art and not shown or described herein in detail move the wax paper 76 at a different speed than the paper 10 so that the surface of the wax paper 76 is rubbed over the surface of the paper 10 on which the indicia 12 is printed. This differential velocity causes wax from the paper 76 to be deposited on the surface of the paper 10, and onto the printed indicia 12.

The hardness of the roller 78 and 80 is not believed to significantly affect the transfer of wax onto the paper 10. The pressure between the rollers 78 and 80 does. It is believed that the more interference between the surface of the rollers 78 and 80, the better the transfer of wax from the wax paper 76 to the paper 10. An interference of 0.010 inches was found suitable.

Another variable affecting the transfer of wax is the relative speed of the wax paper 76 to the paper 10. Speed ratios of 1:1, 1:10, and 1:20 applied sufficient wax to inhibit smearing of the printed indicia 12. A ratio of 1:100, wherein the wax paper 76 speed was 100 times slower than the speed of the paper 10, did not transfer enough wax to sufficiently inhibit smearing. A ratio of 1:50 is believed to work, but has not been tested. A ratio in the range of 1:20 to 1:30 is believed preferable, but has not been verified by testing.

In applying the wax directly to the printed paper 10 and printed indicia 12, the exact mechanism by which the wax works to sufficiently inhibit smearing is not known. It is hypothesized that there is a preferential deposit of wax on the printed indicia 12 due to the raised nature of the printed indicia 12 as previously described. The previous hypothesis are still believed applicable, but in the case of wax paper 76, the preferential application of wax to the printed indicia 12 is believed to be caused by the raised nature of the printed indicia 12, rather than by the triboelectric attraction previously hypothesized.

FIGS. 9 and 10 show still another variation of the embodiment described in FIG. 4, and like numbers will be used to refer to like components. A container 82 takes the form of a generally elongated container with its longitudinal axis parallel to the longitudinal axis of drive roller 20. The interior of the container 82 is accessible so that coating material 40 can be placed in the containier 82. Along a predetermined length of one side of the container 82 are a plurality of apertures which preferably take the form of a wire mesh 84. The apertures in the wire mesh 84 are sized with respect to the size of the coating material 40 so that a portion of the coating material 40 will flow through the mesh 84 when a slight impulse or agitation is imparted to the container 82.

Referring to FIG. 9, the container 82 is supported by a rod 56, the longitudinal axis of which is substantially parallel to the longitudinal axis of drive roller 20. The ends of the rod 56 are in turn connected to, and supported by a lever 58. A first end of the lever 58 is pivotally mounted. At the opposing end of the lever 58 is a second end 62. A stop 63 limits the motion of the lever 58 in one direction.

A rotating brush 36 having a generally cylindrical shape and having bristles 38, is rotatably mounted so that the longitudinal axis of the brush 36 is substantially parallel to the longitudinal axis of the drive roller 20. The brush 36 has a central shaft 37 which has a two lobed cam 84 at one end of the shaft 37. The brush 36 and the cam 84 are positioned so that the lobes of the cam 84 releasably contact the second end 62 of the lever 58. The lobes of the cam 84 lift and release the lever 58 and correspondingly lift and release the container 82. When released, the container 82 falls until stopped by the stop 63. The sudden stop of the motion by the stop 63 agitates the coating material 40 in the container 82 and causes a portion of that material 40 to be dispensed through the mesh 84.

A transfer roller 86 is placed adjacent to the container 82 so that the coating material 40 dispensed through the wire mesh 84 is picked up by the transfer roller 86 and transferred to the brush 36. The transfer roller s86 has a substantially cylindrical shape and is rotatably mounted with its longitudinal axis substantially parallel to the longitudinal axis of the brush 36. The transfer roller 86 is preferably located below the wire mesh 84 so that the coating material 40 falls onto the transfer roller 86. The brush 36 is preferably in contact with the transfer roller 86 to enable the bristles 38 to pick up and transfer the coating material 40 from the transfer roller 86. The brush 36 transfers the coating material 40 to the apertures 42 as previously described. A collector shield 88 is located adjacent the location where the brush 36 contacts the aperatures 42 so as to collect any of the coating material 40 that is not transferred to the paper 10, and to prevent the coating material from falling onto other parts of the mechanism.

FIG. 11 shows a means to remove portions of the coating material 40 from the paper 10. A removal device is placed adjacent, and preferably in contact with the surface of the paper 10 on which the printed indicia 12 is printed, so as to remove a portion of the coating material 40 after it has been applied. By this means, any excess coating material 40 can be removed so as to more closely control the amount of coating material 40 on the paper 10.

Preferably the removal device takes the form of a rotating removal brush 90 having bristles 92 which form a generally cylindrical shape. The removal brush 90 has a longitudinal axis that is substantially parallel to the longitudinal axis of drive roller 20. A leaf spring 91 runs the length of the brush 90 and is positioned so that when a piece of paper 10 passes between the removal brush 90 and the spring 91, the spring 91 pushes the paper 10 into contact with the brush 91. The removal brush 90 thus rubs against the surface of the paper 10 to brush off a portion of the coating material 40. The force of the contact between the brush 90 and the paper 10, the relative rotational rates between the brush 90 and the paper 10, and the density of the bristles 92 in the brush 90 can be varied to determine the amount of the coating material 40 removed from the paper 10.

The coating material 40 is dislodged from the removal brush 90 by rubbing against a projection 94, which causes the bristles 92 of the brush 90 to flex and release suddenly so as to propel the coating material 40 off of the brush 90 as in the flicker mechanism described with reference to FIG. 3 and *3a*. The projection 94 preferably takes the form of a protruding lip running the length of the removal brush 90. The projection 92 abuts against the bristles of the brush 90 sufficiently to cause the bristles to bend. As the brush 90 rotates, the bristles are released from their flexed position so as to causes the coating material 40 to be dislodged. A collecting container 96 is located adjacent the removal brush 90 and the projection 94 so as to collect the coating material 40 as it is dislodged from the bristles 92.

I claim:

1. An apparatus for applying a coating to the surface of a check having printed indicia on said surface of said check, comprising:

applicator means for applying a sufficient amount of a powdered coating material to the surface of said check on which said printed indicia is located to prevent visually perceptible smearing of said printed indicia during processing of said check by a reader/scanner, said applicator means not applying so much of said material so as to inhibit writing with a ball point pen on any portion of said check coated with said coating material, said applicator means comprising:

a housing having at least a first aperture therein, said first aperture being located adjacent one surface of said check, said one surface of said check having printed indicia thereon;

a container for said coating material having at least a second aperture through which said coating material can pass, said second aperture being sized with respect to the particle size of said coating material to restrain said coating material from freely flowing through said second aperture;

impulse means for providing an impulse force to said container to cause a predetermined amount of said coating material to pass through said second aperture; and transfer means for transferring said coating material which passes through said second aperture to said first aperture, said coating material passing through said first aperture onto said check.

2. An apparatus as defined in claim 1, wherein said transfer means comprises:

rotating brush means contacting said coating material so as to transport a predetermined amount of said coating material to said first aperture.

3. An apparatus for applying a coating to printed indicia on paper, comprising:

printing means for printing perceptible indicia on a surface of said paper, at least a portion of said perceptible indicia projecting above the surface of said paper;

applicator means for applying a powdered coating material to the surface of said paper on which said indicia is printed, said applicator means applying an amount of said coating material to prevent visually perceptible smearing of said indicia after 128 rubs on a Southland Rub Tester using a four-pound weight on paper having a surface roughness of about 80–150 Sheffield, said applicator means not applying so much of said coating material to inhibit writing with a ballpoint pen on said paper coated with said coating material, and wherein said applicator means comprises:

a housing having at least a first aperture therein, said first aperture being located adjacent one surface of said paper, said one surface of said paper having printed indicia thereon;

a container for said coating material having at least a second aperture through which said coating material can pass, said second aperture being sized with respect to the particle size of said coating material to restrain said coating material from freely flowing through said second aperture;

impulse means for providing an impulse force to said container to cause a predetermined amount of said coating material to pass through said second aperture; and transfer means for transferring said coating material which passes through said second aperture to said first aperture, said coating material passing through said first aperture onto said paper.

4. An apparatus as defined in claim 3, wherein said printing means comprises a non-impact printer.

5. An apparatus as defined in claim 3, wherein said transfer means comprises:

rotating brush means contacting said coating material so as to remove and transport a portion of said coating material to said first aperture.

6. An apparatus for applying material to the surface of paper, comprising:

printing means for printing perceptible indicia on a surface of said paper;

applicator means for preferentially applying a coating material to said printed indicia on the surface of said paper on which said indicia is printed, said coating material having the ability to be preferentially applied to said printed indicia as printed by said printing means, a triboelectric charge on one of said perceptible indicia or coating material causing said preferential application between the perceptible indicia and the coating material, said coating material comprising a powder, said applicator means comprising:

a housing having at least a first aperture therein, said first aperture being located adjacent one surface of said paper, said one surface of said paper having printed indicia thereon;

a container for said coating material having at least a second aperture through which said coating material can pass, said second aperture being sized with respect to the particle size of said coating material to restrain said coating material from freely flowing through said second aperture;

impulse means for providing an impulse force to said container to cause a predetermined amount of said coating material to pass through said second aperture; and transfer means for transferring said coating material which passes through said second aperture to said first aperture, said coating material passing through said first aperture onto said paper.

7. An apparatus as defined in claim 6, wherein said printing means comprises a non-impact printer.

8. An apparatus as defined in claim 6 wherein said transfer means comprises:

rotating brush means contacting said coating material so as to remove and transport a portion of said coating material to said first aperture, said removed and transported coating material passing through said first aperture.

9. An apparatus for dispensing powder onto the surface of a piece of paper having printed indicia on a first surface thereon, said paper passing said apparatus, comprising:

a housing having a plurality of apertures therein, said apertures being located so as to be adjacent said first surface of said paper as said paper passes said apertures, said coating material passing through said apertures to contact said first surface of said paper, said coating material inhibiting smearing of printed indicia after said indicia is printed on said paper, said coating material comprising a powder;

spring means for urging said paper against said plurality of apertures; and rotating brush means contacting said coating material so as to transport a portion of said coating material to said aperture and cause said transported coating material to pass through said aperture to contact said first surface of said paper adjacent said aperture.

10. An apparatus as defined in claim 9, wherein said coating material comprises powdered Teflon fluorocarbon.

11. An apparatus as defined in claim 9, further comprising:

a non-impact printer for printing said printed indicia on said paper, and wherein said coating material can be preferentially applied to said printed indicia.

12. An apparatus as defined in claim 9, wherein said brush means applies an amount of said coating material so that said printed indicia on said first surface of said paper will not visually smear for at least four times the number of rubs that cause smearing of said printed indicia without said coating material.

13. An apparatus as defined in claim 9, wherein said brush means applies between about 0.8 and 17 micrograms per square centimeter of said coating material.

14. An apparatus as defined in claim 9, wherein said brush means applies an amount of said coating material so that said printed indicia on said first surface of said paper will not visually smear for at least sixteen times the number of rubs that cause smearing of said printed indicia without said coating material.

15. An apparatus for dispensing powder on to the surface of a piece of paper comprising:

a housing having at least a first aperture therein, said first aperture being located adjacent one surface of said paper, said one surface of said paper having printed indicia thereon;

a container for a powdered coating material, said coating material inhibiting smearing of said printed indicia, said container having at least a second aperture through which said coating material can pass, said second aperture being sized with respect to the particle size of said coating material to restrain said coating material from freely flowing through said second aperture;

impulse means for providing an impulse force to said container to cause a predetermined amount of said coating material to pass through said second aperture; and transfer means for transferring said coating material which passes through said second aperture to said first aperture, said coating material passing through said first aperture onto said paper.

16. An apparatus as defined in claim 15, wherein said transfer means comprise a rotating transfer roller transferring said coating material to a rotating brush, which in turn transfers said coating material to said paper.

17. An apparatus as defined in claim 15, wherein said transfer means comprises a rotating brush, and wherein said impulse means comprises:

a lever, pivoted at one end, said container communicating with said lever so as to move when said lever pivots;

a cam on said rotating brush, said cam causing said lever and container to rise and fall;

stop means to arrest the fall of said container and thereby impart an impulse to said container to cause said coating material to pass through said second aperture.

* * * * *

UNITED STATES PATENT AND TRADEMARK OFFICE

CERTIFICATE OF CORRECTION

PATENT NO. : 4,779,558

DATED : October 25, 1988

INVENTOR(S) : Edward R. Gabel, Ronald R. Surya, William J. Hanson, Mary B. Burke It is certified that error appears in the above-identified patent and that said Letters Patent is hereby corrected as shown below:

Column 1, line 20, change "time" to --times--.

Column 3, line 62, change "paer" to --paper--.

Column 9, line 38, change "beings" to --begins--.

Column 10, line 15, change "laster" to --lasted--.

Column 13, line 31, change "S86" to --86--.

Signed and Sealed this

Second Day of May, 1989

*Attest:*

*Attesting Officer*

DONALD J. QUIGG

*Commissioner of Patents and Trademarks*